US011208243B2

(12) United States Patent
Pilotti

(10) Patent No.: US 11,208,243 B2
(45) Date of Patent: Dec. 28, 2021

(54) CLOSURE CAPSULE

(71) Applicant: BORMIOLI PHARMA S.P.A., Milan (IT)

(72) Inventor: Emanuel Pilotti, Fontevivo (IT)

(73) Assignee: BORMIOLI PHARMA S.P.A., Milan (IT)

( * ) Notice: Subject to any disclaimer, the term of this patent is extended or adjusted under 35 U.S.C. 154(b) by 0 days.

(21) Appl. No.: 17/055,804

(22) PCT Filed: May 29, 2019

(86) PCT No.: PCT/IB2019/054426
§ 371 (c)(1),
(2) Date: Nov. 16, 2020

(87) PCT Pub. No.: WO2020/003024
PCT Pub. Date: Jan. 2, 2020

(65) Prior Publication Data

US 2021/0206548 A1 Jul. 8, 2021

(30) Foreign Application Priority Data

Jun. 28, 2018 (IT) ..... 102018000006793

(51) Int. Cl.
*B65D 51/28* (2006.01)

(52) U.S. Cl.
CPC ..... *B65D 51/2835* (2013.01); *B65D 51/2821* (2013.01)

(58) Field of Classification Search
CPC ..... B65D 51/2835; B65D 51/2821; B65D 51/285; B65D 51/2814; B65D 17/00
(Continued)

(56) References Cited

U.S. PATENT DOCUMENTS 3,521,745 A * 7/1970 Schwartzman .... B65D 81/3211 206/222
6,148,996 A 11/2000 Morini
(Continued)

FOREIGN PATENT DOCUMENTS

EP 0963325 11/2001
EP 2700589 2/2014
(Continued)

*Primary Examiner* — Rafael A Ortiz
(74) *Attorney, Agent, or Firm* — Pearne & Gordon LLP

(57) ABSTRACT

A closure capsule for closing a container, comprising: —a stopper (2) applicable to the container and comprising a first perforable membrane (21); —a first cutter (31) of the first membrane, said first cutter (31) being movable between a start stroke position and an end stroke position; in the start stroke position of the first cutter (31), in combination with at least the first membrane (21), the first cutter (31) delimits a first tank (41) for containing a first substance; in the end stroke position of the first cutter (31) at least a part of the first membrane (21) being perforated to enable passage of the first substance from the first tank (41) to the container. The stopper (2) comprises at least a second perforable membrane (22). The capsule (1) comprises a second cutter (32) for cutting the second membrane, said second cutter (32) being movable between a start stroke position and an end stroke position; in the start stroke position of the second cutter (32), in combination with at least the second membrane (22), the second cutter (32) delimiting a second tank (42) for containing a second substance; in the end stroke position of the second cutter (32) at least a part of the second membrane (22) being perforated and enabling passage of the second substance from the second tank (42) to the container.

10 Claims, 3 Drawing Sheets

(58) Field of Classification Search
USPC ..... 206/219, 222; 221/80, 81
See application file for complete search history.

(56) References Cited

U.S. PATENT DOCUMENTS

| | | | | |
|---|---|---|---|---|
| 8,839,982 | B1 * | 9/2014 | Anderson | B65D 51/2835 220/521 |
| 9,452,870 | B1 * | 9/2016 | Anderson | B65D 47/0842 |
| 2007/0102394 | A1 | 5/2007 | Olsen et al. | |
| 2012/0168326 | A1 | 7/2012 | Pannu | |
| 2012/0305519 | A1 * | 12/2012 | Lee | B65D 47/12 215/316 |
| 2014/0305818 | A1 * | 10/2014 | Lee | B65D 51/2842 206/222 |
| 2015/0001108 | A1 | 1/2015 | Lee et al. | |
| 2016/0090222 | A1 | 3/2016 | Lee | |

FOREIGN PATENT DOCUMENTS

| | | | | |
|---|---|---|---|---|
| EP | 2700589 | A2 * | 2/2014 | B65D 51/2835 |
| WO | 2011027177 | | 3/2011 | |

* cited by examiner

CLOSURE CAPSULE

TECHNICAL FIELD

The present invention relates to a closure capsule for closing a container.

BACKGROUND ART

A container is known containing a liquid and provided with a mouthpiece occluded by a closure capsule. The latter contains a powdered product that falls into the container at the time of opening the capsule. This allows better conservation of the powdered product which can remain separate from the liquid present in the container. As the capsule is opened it is certain that the powdered product is mixed with the liquid.

On this point, the capsule comprises a cutter and a frangible wall which, in combination, define a containment tank of the product. During the opening of the capsule the user acts on an outer cover that pushes the cutter against the frangible wall determining the breakage thereof and the pouring of the powdered material into the container.

An example of a similar capsule is described in EP0963325.

A known capsule is also disclosed in US 2012/305519.

DISCLOSURE OF THE INVENTION

The object of the present invention is to propose a capsule that allows the possibilities for use to be optimised.

The stated technical task and specified objects are substantially achieved by a capsule comprising the technical features disclosed in one or more of the appended claims.

BRIEF DESCRIPTION OF DRAWINGS

Further characteristics and advantages of the present invention will become more apparent from the following indicative and therefore non-limiting description of a capsule as illustrated in the appended figures, in which.

DETAILED DESCRIPTION OF PREFERRED EMBODIMENTS OF THE INVENTION

Figure 1:
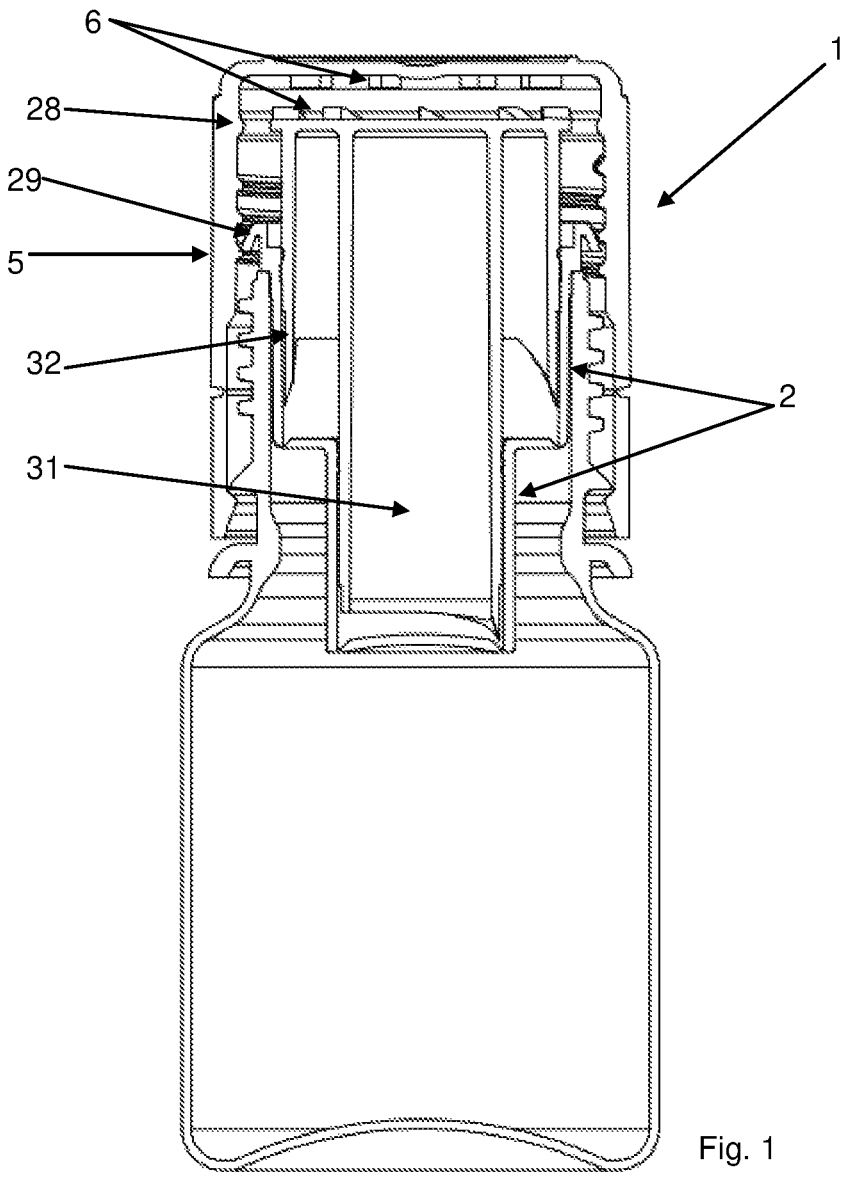
FIG. 1 is a sectional view of a capsule according to the present invention applied to a container.

In the appended figures, reference number 1 denotes a closure capsule for closing a container. Such capsule 1 comprises a stopper 2 applicable to the container, typically by means of pressure. The stopper 2 defines a concavity. It is typically a single body, but could be an assembly of various components. It is intended to project into the container.

The stopper 2 comprises a first perforable membrane 21 (sometimes known in the sector as a frangible membrane 21). The first membrane 21 is substantially a disc-like element. For example, such first membrane 21 is made of plastic material. The first membrane 21 can for example comprise a pre-incision 210 that facilitates the breakage thereof.

Appropriately such pre-incision 210 allows the cutting to be facilitated along a pre-defined trajectory. Typically, the pre-incision 210 extends along a circumference or an arc of a circumference.

Figure 2:
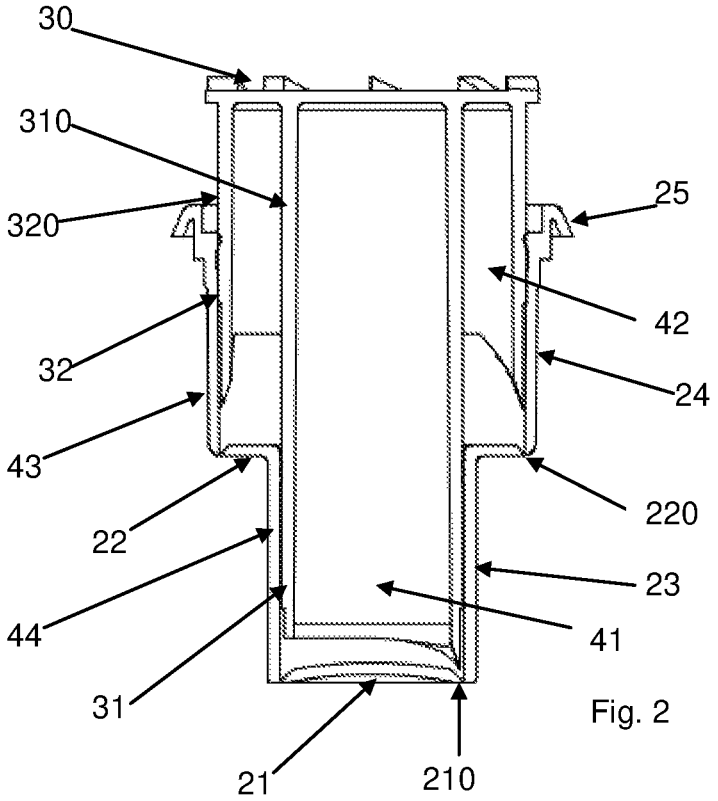
FIGS. 2 and 3 show sectional views, in two different configurations, of a component of FIG. 1.
Figure 3:
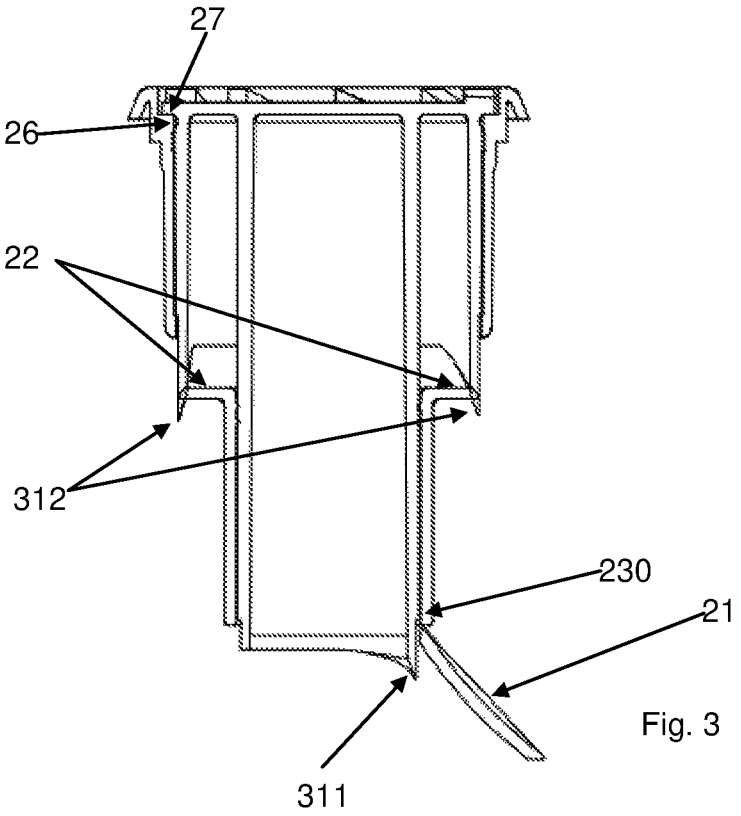
Figure 4:
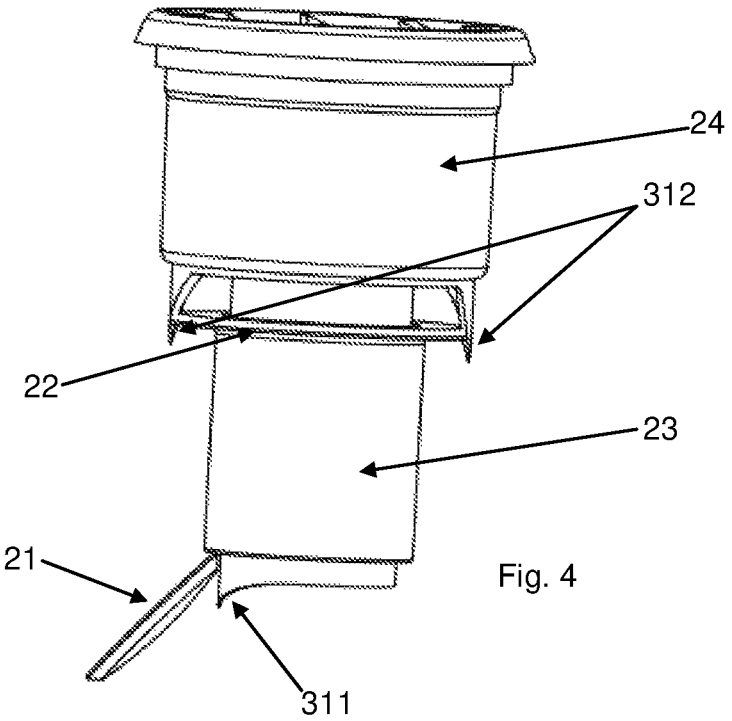
FIG. 4 shows a perspective view of what is illustrated in FIG. 3.

The capsule 1 further comprises a first cutter 31 of the first membrane. The first cutter 31 is movable between a start stroke position, see FIGS. 1 and 2, and an end stroke position, see FIGS. 3 and 4 (reference is made to the cutting stroke of the first cutter 31).

In the start stroke position of the first cutter 31, in combination with at least the first membrane 21, the first cutter 31 delimits a first tank 41 for containing a first substance. The first substance may be a solid product (granular/powdered) or a liquid.

In particular, the first cutter 31 and the first membrane 21 delimit the first tank 41 on two opposite sides. The stopper 2 also contributes to laterally delimiting the first tank 41.

In the end stroke position of the first cutter 31 at least a part of the first membrane 21 is cut to enable passage of the first substance from the first tank 41 to the container. Such cut is due to the first cutter 31.

The stopper 2 comprises at least a second perforable membrane 22.

The capsule 1 comprises a second cutter 32 for cutting the second membrane 22. The second cutter 32 is movable between a start stroke position and an end stroke position (reference is made to a cutting stroke of the second cutter 32). In the start stroke position of the second cutter 32, in combination with at least the second membrane 22 the second cutter 32 delimits a second tank 42 for containing a second substance. The second substance may be a solid product (granular/powdered) or a liquid. The second membrane 22 is shaped like an annular crown. The first cutter 31 internally crosses the annular crown (both in the start stroke position and in the end stroke position of the first cutter 31).

In the end stroke position of the second cutter 32 at least a part of the second membrane 22 is perforated and enables passage of the second substance from the second tank 42 to the container.

The stopper 2 further comprises an annular portion 23 that extends between (and in particular connects) the first and the second perforable membrane 21, 22. Such annular portion 23 is substantially cylindrical. As is clear by comparing FIGS. 2 and 3 the annular portion connects the first and the second membrane 21, 22 both in the start stroke position and in the end stroke position of the first and of the second cutter 31, 32 (in the latter case through a joining flap 230 as will be better explained below).

The stopper 2 further comprises a wall 24 (preferably substantially cylinder shaped) intended to come into contact with an inner portion of the container. The second cutter 32 slides near the wall 24 and is overlapped therewith. Furthermore, the stopper 2 comprises a perimeter edge 25 intended to be abutted by a mouthpiece of the container without projecting into the container. The edge 25 is located at an opposite end of the stopper 2 with respect to the first membrane 21. Appropriately, the wall 24 extends between the perimeter edge 25 and the second membrane 22. The stopper 2 defines an upper cup 43 and a lower cup 44; the upper cup 43 houses the second substance, the lower cup 44 houses the first substance. In the start stroke position of the first and the second cutter 31, 32 the lower and upper cups 43, 44 are connected by the second membrane 22. They preferably have a substantially cylindrical side surface. In the start stroke position the passage from the upper cup 43 to the lower one 44 is obstructed by the presence of the first cutter 31.

Appropriately, the first and the second cutter 31, 32 are made of a plastic material. Typically, such plastic material is more rigid than the material used for realising the first and the second membrane 21, 22.

In a particular solution, not illustrated, the first and the second cutter 31, 32 may be separate and independent.

Preferably, the first and second cutter 31, 32 move solidly with respect to one another. In particular they are a single body. For example, they are made of the same material defining a single monolithic body. In the start and end stroke position of the first cutter 31 also the second cutter 32 is in its own start and end stroke position. The first and second cutter 31, 32 move along the same direction.

Advantageously, the second cutter 32 is coaxial to the first cutter 31. Advantageously, the second cutter 32 surrounds at least a portion of the first cutter 31 by 360°.

Appropriately, the first cutter 31 comprises a shaft 310 (preferably hollow, such cavity being able to contribute to defining the first tank 41).

The second cutter 32 comprises a shaft 320 (preferably hollow, such cavity being able to contribute to defining the second tank 42). The shaft 320 of the second cutter 32 extends for a minimum length of the shaft 310 of the first cutter 31.

The shaft 310 of the first cutter 31 and the shaft 320 of the second cutter 32 extend from a common base 30 and project respectively towards the first and the second membrane 21, 22.

The shaft 310 of the first cutter 31 terminates with a cutting member 311. Such cutting member 311 is located at an opposite end with respect to the common base 30. The cutting member 311 of the first cutter 31 comprises two strips converging in a pointed zone.

The shaft 320 terminates with at least one cutting member 312, preferably with at least two cutting members 312 arranged along the perimeter of the end of the shaft 320. Such cutting members 312 are advantageously diametrically opposite each other.

The second tank 42 surrounds at least in part (but preferably along an arc of 360°) the first tank 41. Appropriately in the start stroke position the first cutter 31 (in particular the shaft 310 of the first cutter 31) contributes to delimiting both the first tank 41 and the second tank 42. In particular it externally delimits the first tank 41 and internally the second tank 42.

In the start stroke position of the first cutter 31 the distance between the first cutter 31 and the pre-incision 210 of the first membrane 21 is shorter than the distance between the second cutter 32 and the pre-incision 220 of the second membrane 22, evaluated in the start stroke position of the second cutter 32 (as explained previously in the preferred solution the start stroke position of the first cutter 31 is assumed simultaneously with the start stroke position of the second cutter 32 and vice versa). In the preferred solution the first cutter 31 starts cutting the first membrane 21 before the second cutter 32 starts cutting the second membrane 22.

Appropriately, the capsule 1 comprises an activating cover 5 of the first and second cutter 31, 32. The cover 5 surrounds at least a part of the first and second cutter 31, 32. The cover 5, when the package is intact, prevents the user from coming into contact with the first and the second cutter 31, 32. The covering 5 suitably comprises a security strip. It is located on the opposite side with respect to the common base 30. It is intended to surround the container.

In a configuration in which both the first and the second cutter 31, 32 are in the end stroke position the second membrane 22 is connected by interference to the first cutter 31. Therefore, the second membrane 22 is solidly constrained to the first cutter 31.

Still in a configuration in which both the first and the second cutter 31, 32 are in the end stroke position the second membrane 22 is completely separate, following the action of the second cutter 32, from the wall 24 of the stopper 2. The second membrane 22 extends radially starting from the annular portion 23.

Appropriately the annular (or better tubular) portion 23 that connects the first and the second membrane 21, 22 extends axially along an advancement direction of the first and the second cutter 31, 32 (to pass from the start stroke position to an end stroke position).

In a configuration in which both the first and the second cutter 31, 32 are at the end stroke, the annular portion 23 is connected by means of a joining flap 230 to the first membrane 21. Furthermore, the annular portion 23 is connected to the second membrane 22, the latter defining a circumferential flap connected to the annular portion 23 for the entire perimeter (circumferential) extension thereof. Appropriately, the first and second membrane 21, 22 are connected to the annular portion 23 respectively at two opposite ends. Still in the configuration in which both the first and the second cutter 31, 32 are in the end stroke position the annular portion 23 is connected by interference to the first cutter 31 (which preferably crosses it from one side to the other).

In the preferred solution in the end stroke position the first cutter 31 is rotationally translated with respect to the start stroke position. Likewise, this can be repeated for the second cutter 32.

The cover 5 determines the movement of both the first and the second cutter 31, 32.

In particular, the capsule 5 comprises transmitting means 6 for transmitting to the first and the second cutter 31, 32 an opening torque of the first and the second membrane 21, 22.

Such opening torque is exerted by a user at the moment when it is desired to mix the substances present in the first and the second tank 41, 42 and the liquid present in the container. This occurs before the first use. The transmitting means 6 when enmeshed enables a solidly rotational-translational movement of the covering 5 and of the first and the second cutter 31, 32.

The transmitting means 6, if enmeshed, thus enables the transmission of the opening torque without relative sliding between the cover 5 and the first and the second cutter 31, 32. This promotes the transmission of the torque and a reduction of the effort by the user.

The cover 5 therefore draws with a rotational-translational movement the first and second cutter 31, 32. The transmitting means 6 comprises, for example, one or more teeth afforded on an inner surface of the cover that interact with corresponding abutments placed on the common base 30. The teeth and abutments are opposite each other as exemplified in FIG. 1.

In a further constructive solution, not illustrated, a third tank may be provided. Such third tank advantageously surrounds the first and the second tank 41, 42. In that case the capsule 1 comprises a third cutter dedicated to the opening of the third tank.

The object of the present invention is also a container comprising the capsule 1 applied to the container.

A further object of the present invention is an operating method of a capsule having one or more of the characteristics described hereinabove.

Such method comprises the step of cutting, using the first cutter 31, at least a part of the first membrane 21 in order to enable a falling of the first substance from the first tank 41 internally of the container. Appropriately, at the end of cutting the first membrane 21 remains connected by means of a joining flap 230 to the annular portion 23.

The method also comprises the step of cutting, using the second cutter 32, at least a part of the second membrane 22 in order to enable a falling of the second substance from the second tank 42 internally of the container. At the end of cutting, the second membrane 22 remains connected to the annular portion 23. It is instead completely separate from the wall 24. In fact, the cutting takes place at a radially more external portion of the second membrane 22.

The method comprises the step of transmitting a cutting torque from the cover 5 both to the first and to the second cutter 31, 32. The transmission of the cutting torque envisages applying a screwing torque of the cover 5 on the container. This enables the first and the second cutter 31, 32 to be pushed towards the container. During such displacement the first and the second membrane 21, 22 are intercepted and cut respectively by the first and by the second cutter 31, 32. The step of transmitting a cutting torque from the cover 5 both to the first and to the second cutter 31, 32 envisages determining a rotational-translational movement of the first and of the second cutter 31, 32. In fact, the cover 5 follows a rotational-translational movement determined by the advancement along the thread of the container. The cover 5 engaging the first and the second cutter 31, 32 makes them solidly constrained thereto during the displacement from the start stroke position to the end stroke position.

The step of cutting the first membrane 21 determines a cut that is not closed onto itself. The first membrane 21 also in a maximum cutting configuration (end stroke position of the first cutter 31) has a joining flap 230 with other parts of the stopper 2. This prevents the falling of the first membrane into the container also in the maximum cutting configuration.

The step of cutting the second membrane 22 determines a cut along a self-closed line and determines a separation of the second membrane 22 from a portion of the stopper 2 destined to contact the container (and that is radially more external). In this way, the second membrane 22 remains joined to the first membrane 21 and movable together with the first and the second cutter 31, 32. In fact, the first and the second membrane are connected by means of the annular portion 23. When either the first or the second membrane 21, 22 are cut respectively by the first and the second cutter 31, 32, the annular portion 23 is connected by interference to the first cutter 31 placed inside it. Such interference is due to friction.

In the preferred solution, the transmitting means 6 is initially disengaged (see FIG. 1). The user applies a screwing torque of the cover 5 on the container and this leads the transmitting means 6 to engage to one another. At this point a further screwing torque defines the above-indicated opening torque.

After cutting the first and the second membrane 21, 22 the first and the second cutter 31, 32 are solidly constrained to the stopper 2. In fact, a projection 27 afforded on the stopper 2 engages in a corresponding groove 26 afforded on the second cutter 32 (which in the preferred solution is solidly constrained or better in a single body with the first cutter 31). Or vice versa the projection 27 may be afforded on the second cutter 32 and the groove 26 in the stopper 2.

After cutting the first and the second membrane 21, 22 the cover 5 hooks the stopper 2. This is thanks to a raised portion 28 that engages below an anchoring 29 that enables the passage thereof downwards, but not in the opposite direction. In this way the step of unscrewing the cover 5 from the container allows the cover 5 to also extract the stopper 2 hooked thereto. Likewise, the stopper 2 also enables the first and the second cutter 31, 32 hooked thereto to be extracted.

In this way, by unscrewing the cover 5 it also enables the stopper 2 and the first and second cutter 31, 32 to be extracted to allow the extraction of the product present in the container.

The present invention achieves important advantages.

In fact, it enables two different solutes to be introduced into the solvent present in the container to be kept separate until the opening. This enables the possibilities of use to be extended. In particular, the creation of a double housing chamber of corresponding solutes inside the capsule that can be opened with a single action constitutes a further additional advantage.

The invention as it is conceived is susceptible to numerous modifications and variations, all falling within the scope of the inventive concept characterising it. Furthermore, all the details can be replaced with other technically equivalent elements. In practice, all the materials used, as well as the dimensions, can be any according to requirements.

The invention claimed is:

1. A closure capsule for closing a container, comprising:

a stopper (2) applicable to the container and comprising a first perforable membrane (21);

a first cutter (31) of the first membrane, said first cutter (31) being movable between a start stroke position and an end stroke position; in the start stroke position of the first cutter (31), in combination with at least the first membrane (21), the first cutter (31) delimits a first tank (41) for containing a first substance; in the end stroke position of the first cutter (31) at least a part of the first membrane (21) being perforated to enable passage of the first substance from the first tank (41) to the container;

wherein said stopper (2) comprises at least a second perforable membrane (22);

said capsule (1) comprising a second cutter (32) for cutting the second membrane, said second cutter (32) being movable between a start stroke position and an end stroke position; in the start stroke position of the second cutter (32), in combination with at least the second membrane (22) the second cutter (32) delimiting a second tank (42) for containing a second substance; said second tank (42) at least partly surrounds the first tank (41); in the end stroke position of the second cutter (32) at least a part of the second membrane (22) being perforated to enable passage of the second substance from the second tank (42) to the container;

the first cutter (31) comprising a first hollow shaft (310), a cavity defined by the first hollow shaft (310) contributing to defining the first tank (41);

the second cutter (32) comprising a second hollow shaft (320), a cavity defined by the second hollow shaft (320) contributing to defining the second tank (42).

2. The capsule according to claim 1, characterised in that the first and second cutter (31, 32) move solidly with respect to one another; the start stroke position of the first cutter (31) coinciding respectively with the start stroke position of the second cutter (32).

3. The capsule according to claim 1, characterised in that the second cutter (32) is coaxial to the first cutter (31).

4. The capsule according to claim 1, characterised in that the first hollow shaft (310) of the first cutter (31) and the second hollow shaft (320) of the second cutter (32) extending from a common base (30) and extending respectively towards the first and the second membrane (21, 22).

5. The capsule according to claim 1, characterised in that in the start stroke position of the first cutter (31) the distance between the first cutter (31) and a pre-incision (210) of the first membrane (21) is smaller than the distance between the second cutter (32) and a pre-incision (220) of the second membrane (22).

6. The capsule according to claim 1, characterised in that it comprises an activating cover (5) of the first and second cutter (31, 32), said activating cover (5) surrounding at least a part of the first and second cutter (31, 32).

7. The capsule according to claim 1, characterised in that in a configuration in which both the first and the second cutter (31, 32) are in the end stroke position:

at least a part of the first membrane (21) is cut to enable passage of the first substance from the first tank (41) to the container;

the second membrane (22) is completely separated, following the action of the second cutter (32), from a radially more external portion of the stopper (2), and is friction-coupled with the first cutter (31).

8. The capsule according to claim 1, characterised in that the first and second cutter (31, 32) are in the same material defining a single monolithic body.

9. An operating method of a capsule according to claim 1, comprising steps of:

cutting, using the first cutter (31), at least a part of the first membrane (21) in order to enable a falling of the first substance from the first tank (41) internally of the container;

cutting, using the second cutter (32), at least a part of the second membrane (22) in order to enable a falling of the second substance from the second tank (42) internally of the container.

10. The method according to claim 9, characterised in that:

the step of cutting the first membrane (21) determines a cut that does not self-close, the first membrane (21) having, including in a configuration of maximum cutting, a joining flap (230) for joining with other parts of the stopper (2);

the step of cutting the second membrane (22) determines a cut along a self-closed line and determines a separation of the second membrane (22) from a portion of the stopper (2) destined to contact the container;

the second membrane (22) remaining joined to the first membrane (21) and being movable together with the first and the second cutter (31, 32).

* * * * *